United States Patent [19]

Pang

[11] Patent Number: 5,022,255

[45] Date of Patent: Jun. 11, 1991

[54] STRUCTURE OF PUNCH FOR VENETIAN BLIND MANUFACTURE

[76] Inventor: Liu Chia Pang, No. 301, Kuang Fu Rd., Chu Nan Village, Miaoli County, Taiwan

[21] Appl. No.: 518,504

[22] Filed: May 2, 1990

[51] Int. Cl.[5] ..... B21J 7/46

[52] U.S. Cl. ..... 72/444; 72/452; 72/292

[58] Field of Search ..... 72/452, 441, 444; 100/291, 292

[56] References Cited

U.S. PATENT DOCUMENTS

| | | | |
|---|---|---|---|
| 2,725,916 | 12/1955 | Gershater | 72/452 |
| 4,306,443 | 12/1981 | Matsutani | 72/452 |
| 4,550,588 | 11/1985 | Abe et al. | 72/441 |
| 4,691,553 | 9/1987 | Barber | 72/444 |

FOREIGN PATENT DOCUMENTS

| | | | |
|---|---|---|---|
| 0460382 | 10/1949 | Canada | 72/452 |
| 0914958 | 10/1946 | France | 72/452 |
| 0064288 | 3/1913 | Switzerland | 72/452 |

*Primary Examiner*—David Jones

*Attorney, Agent, or Firm*—Morton J. Rosenberg; David I. Klein

[57] ABSTRACT

This invention is related to an improved structure of punch for venetian blind manufacture and more particularly to the one which is including a revolving seat to control the operation of a punch tool guide block assembly, which guide block assembly is comprised of an upper guide block movably connected with a bottom guide block. Through the operation of the adjusting seat, the punching process is rapidly and efficiently alternated.

2 Claims, 4 Drawing Sheets

STRUCTURE OF PUNCH FOR VENETIAN BLIND MANUFACTURE

BACKGROUND OF THE INVENTION

The present invention is directed to a punch for venetian blind manufacture and particularly a punch which includes a rotatable adjusting seat to control the engagement of a punch tool guide block asssembly that is comprised of an upper guide block displaceably coupled to a bottom or lower guide block.

In standard venetian blind manufacturing, the hole punching process is performed by means of several punches collectively controlled by a rotating main axle. When venetian blind blades having different dimensional specifications are to be punched or the punch hole position of a particular venetian blind is to be changed, the punching dies and the punching tools which are disposed in positions where no punch holes are required have to be removed from the punches, because all of the punches are linked to move synchronously. Therefore, it is both time and labor consuming to change the punching assembly in prior art type venetian blind punches. Consequently, the manufacturing costs as well as labor costs are increased.

The main object of the present invention concept is to provide a punch for venetian blind manufacture which includes an easy to operate and rotatable type adjusting seat to alternatively control the operation of the punch tool.

Another object of the present invention is to proivde an improved punch for venetian blind manufacture wherein two guide blocks of the punch tool guide block assembly may be controlled by an adjusting seat member to allow independent operation or to allow the guide blocks to be displaced simultaneously.

Other objects, features and advantages of the present invention will become apparent from the following detailed description to be considered in connection with the annexed drawings as provided herein.

DETAILED DESCRIPTION OF THE PREFERRED EMBODIMENTS

Figure 1:
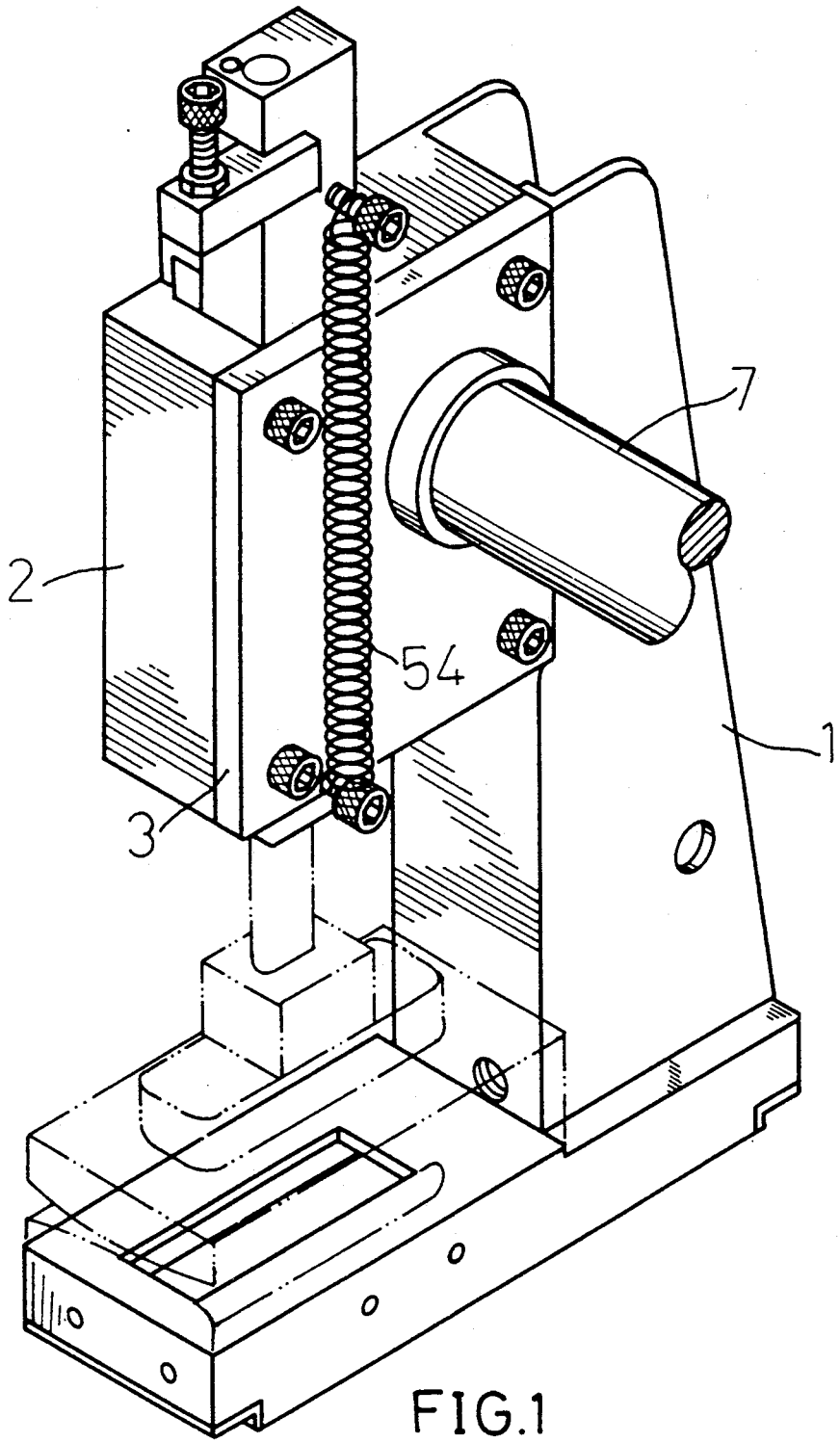
FIG. 1 is a perspective view of a punch embodying the present invention.
Figure 2:
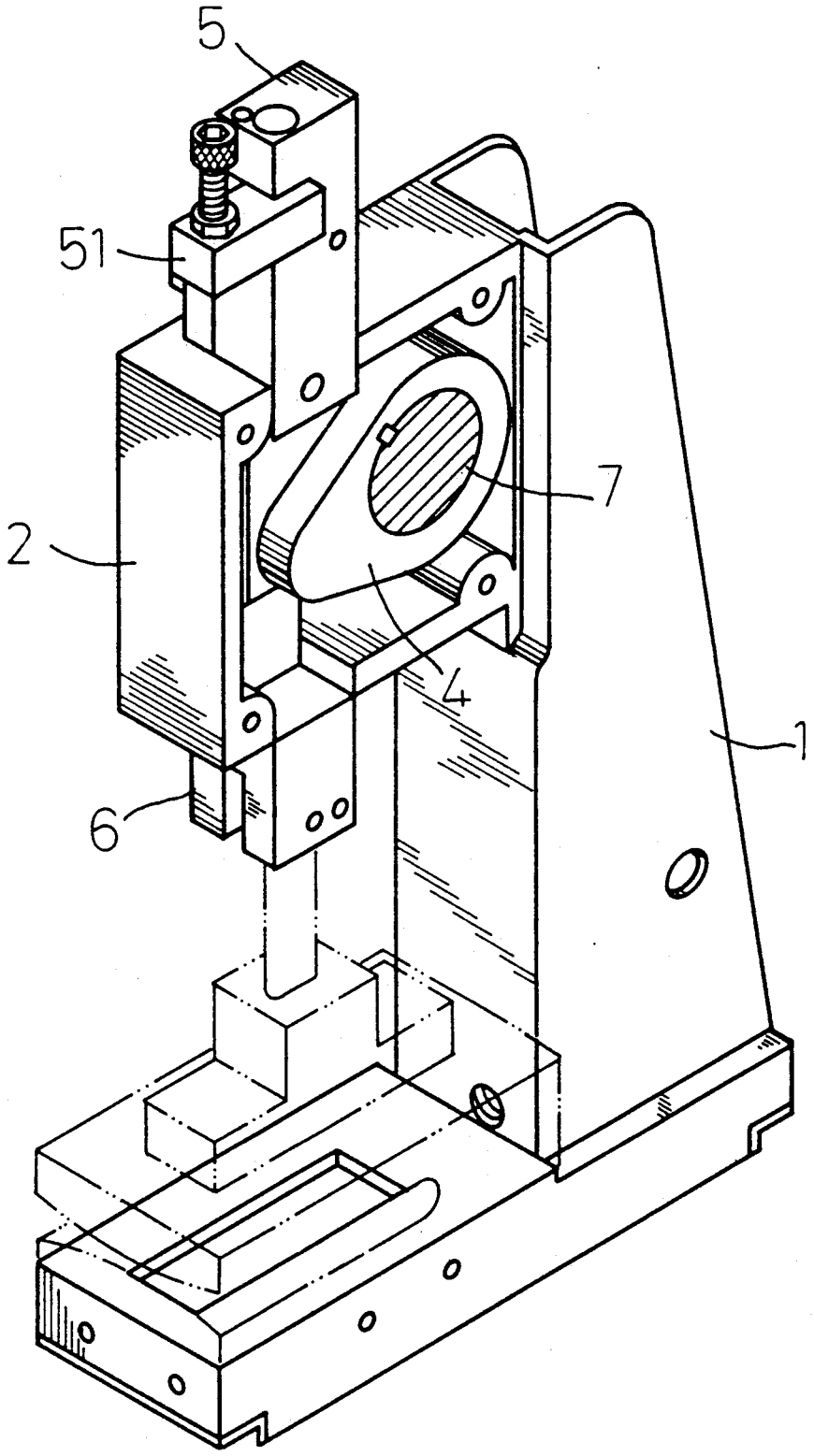
FIG. 2 is an internal assembly view of the present invention.
Figure 3:
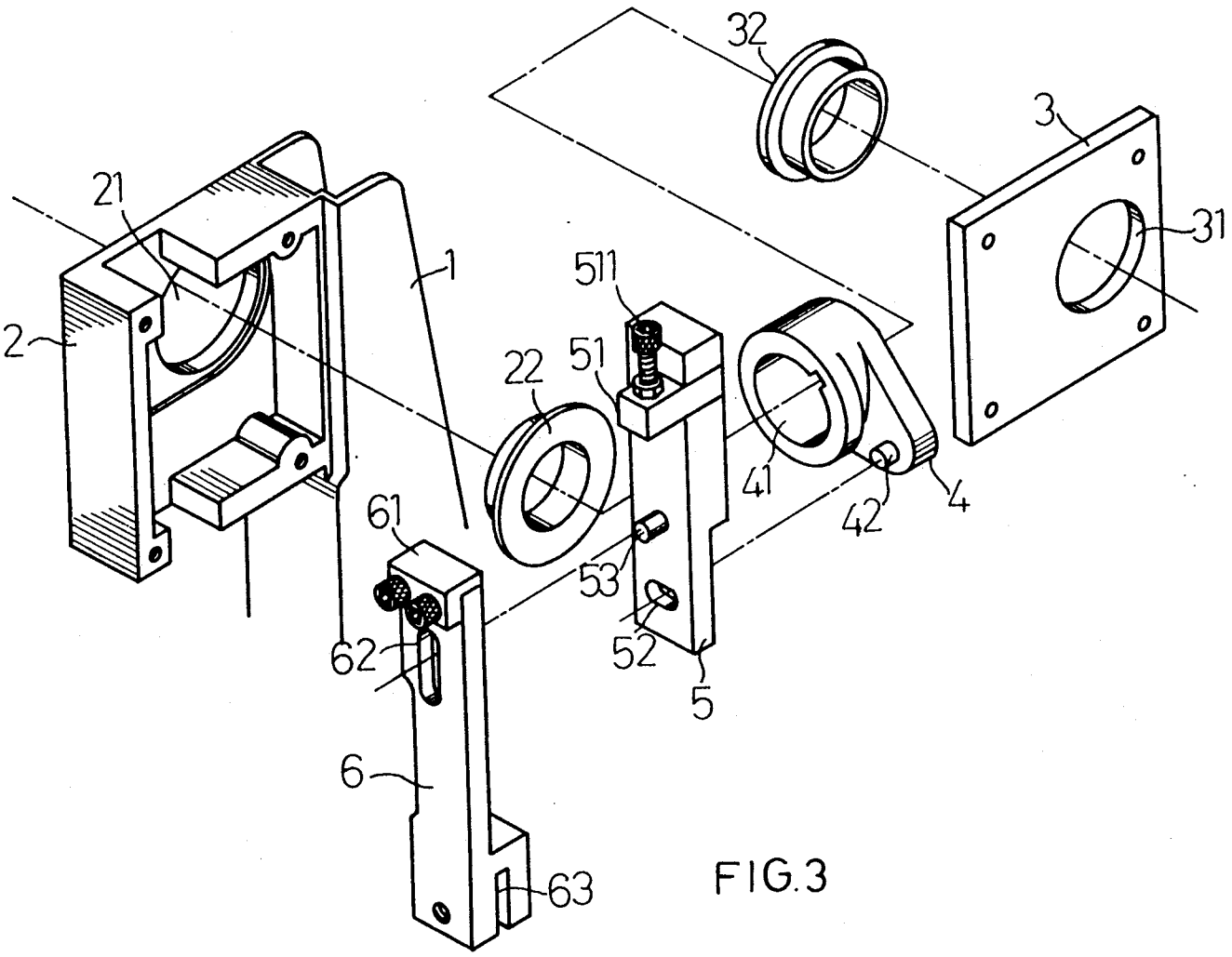
FIG. 3 is a perspective exploded view of the present invention.

With reference to FIGS. 1–3, there is shown a punch comprised of a stand 1, a casing 2, a casing cover 3, an eccentric cam 4, a vertically directed upper guide block 5, and a bottom or lower vertically directed guide block 6.

The casing 2 and the casing cover 3 include aligned through holes or openings 21 and 31 in open communication with each other for mounting therein of bearings or sockets 22 and 32 respectively and for further insertion therethrough of a main driving axle or cam shaft 7. A cam 4 includes a through opening 41 into which the cam shaft or main driving axle 7 is seated.

When the main driving axle or cam shaft 7 is positioned in the opening 41, it is fixedly keyed or fixedly connected thereto by means of a lock pin. A cam dowel

Figure 4:
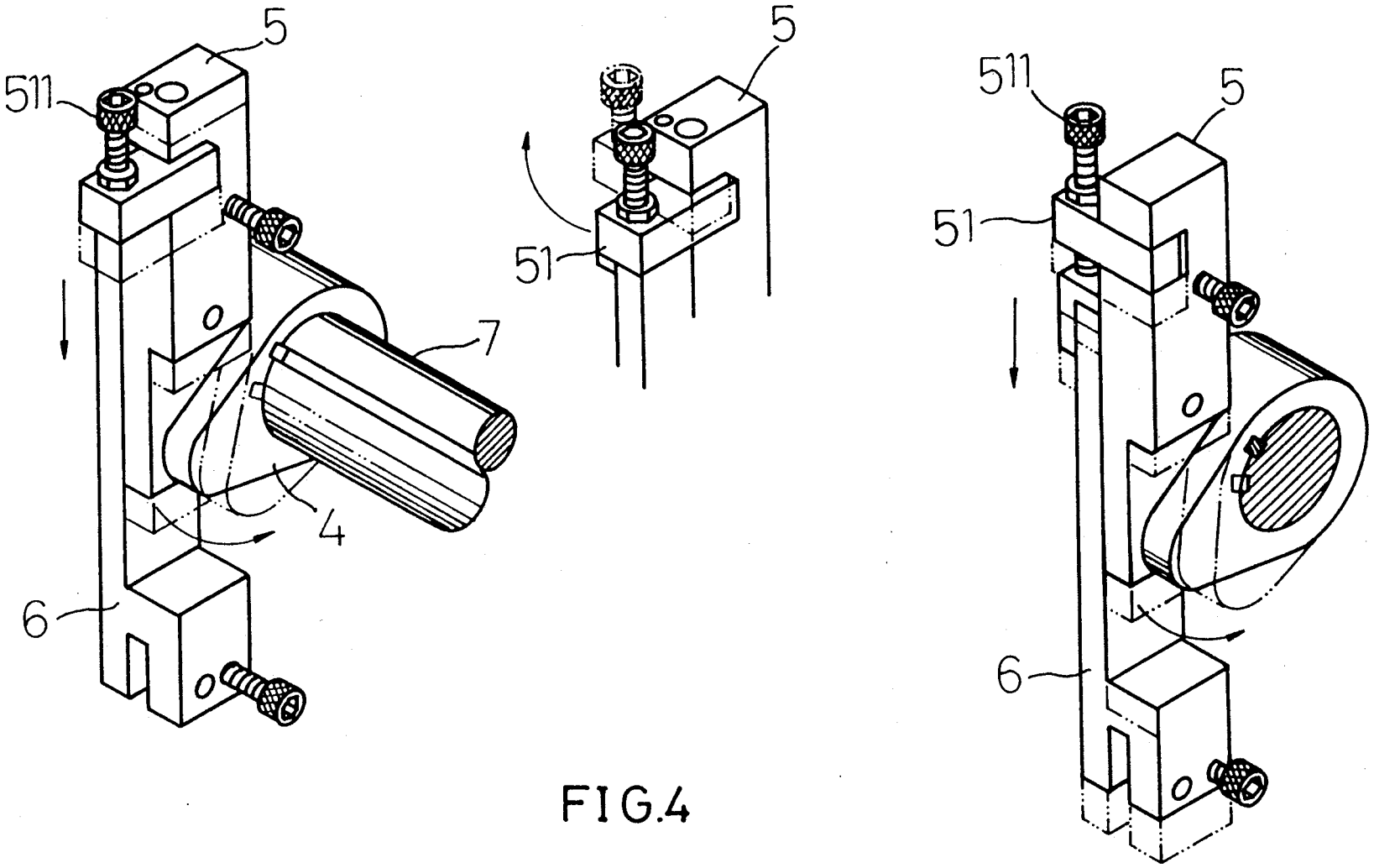
FIG. 4 is a perspective view showing the operation of the present invention.

42 is formed on a projecting portion of the cam 4 as is clearly seen in FIG. 3. The cam dowel 42 is positioned at an inner side face of cam 4. The upper guide block 5 includes an adjusting seat 51 displaceably positioned or set at an upper section of guide block 5 and is confined by spring balls (not shown) to allow rotation of adjusting seat 51 through an angle of 90 degrees clockwise or counterclockwise from the position shown in FIG. 3. The rotation of adjusting seat 51 is clearly shown in the operational FIG. 4.

An adjustment screw 511 is threadedly coupled or mounted on the free end of the adjusting seat 51 to allow for adjustment of vertical position. A guide block slot 52 is formed in the upper guide block 5 at a lower end for insertion and sliding therein of the cam dowel 42 of the cam 4. A guide block dowel 53 is formed on the upper guide block 5 on the back side oppositely faced to the cam 4.

The bottom guide block 6 has an "h" shaped body contour comprising a flat top bearing plate 61 including a top surface and an elongated vertical slot 62 below the bearing plate 61 to allow cam dowel 53 of the upper guide block 5 to slide therein. A notch 63 is provided at a bottom end for connection thereto of a punching tool. A spring 54, shown in FIG. 1 is fixedly mounted on the upper guide block 5 and the bottom guide block 6 by means of threaded securement means such as screws.

In operation, the adjusting seat member 51 is adjustable to allow displacement of the bottom or lower guide block 6 by rotating the adjusting screw 511 for predetermined contact with the top surface of bearing plate 61 of the bottom guide block 6.

When the cam shaft or main driving axle 7 begins to rotate, it will responsively drive the cam 4 in rotative displacement which allows the guide block dowel 42 to displace the lower guide block 6. Due to the fact that the adjusting seat 51 is in contact with the top surface of the bottom guide block 6, the bottom guide block 6 is forced to move downwardly, when the upper guide block 5 is driven in the same downward direction in order to drive a connected punch tool for performing a punching process.

Due to the fact that the dowel 53 of the upper guide block 5 is within the opening or hole 62 of the bottom guide block 6, the bottom guide block 6 will simultaneously be carried by the upper guide block 5 and returns to a reset position for a next operation during a return stroke after each punching.

When no punching operation is required, the adjusting seat member 51 is rotated 90 degrees to remove the adjusting screw 511 from contacting the top bearing plate 61. At this time, when the main driving axle or cam shaft 7 is rotated, such will only drive the upper guide block 5 in a downward displacement and the dowel 53 of the upper guide block 5 slides in the hole 62 and does not displace the bottom guide block 6. The spring 54 maintains the bottom guide block 6 in the position shown in FIG. 1 during this type of operation.

As described above, the present invention is to provide a punch for venetian blind manufacture having numerous features each of which tends to make the structure more practical in use, simple to operate, simple to change operational procedures, and further tends to minimize labor costs.

What is claimed is:

1. A punch for venetian blind manufacture comprising:

a stand;

a casing and cover casing secured to said stand, said casing and cover casing having aligned through openings for passage therethrough of a cam shaft, said casing and cover casing forming an internal chamber;

an eccentric cam keyed to said cam shaft for rotative displacement of said eccentric cam responsive to a rotation of said cam shaft, said eccentric cam having a cam dowel fixedly secured to a projecting portion of said eccentric cam, said eccentric cam located within said internal chamber;

a vertically directed upper guide block having an upper guide block slot for receipt of said cam dowel for reciprocally displacing said upper guide block responsive to a rotative displacement of said eccentric cam;

a horizontally directed adjusting seat member extending from said vertically directed upper guide block, said adjusting seat member being rotatable about a vertical axis;

said vertically directed upper guide block having a guide block dowel secured to a face of said upper guide block;

a lower vertically directed guide block having an elongated vertical slot formed therein for receipt of said guide block dowel, said adjusting seat member for (1) contiguously interfacing with a top surface of said lower guide block for linearly displacing said lower guide block responsive to a rotative displacement of said eccentric cam when said adjusting seat member is in a first position, and (2) for being displaced from said top surface of said lower guide block for independent displacement of said upper guide block with respect to said lower guide block when said adjusting seat member is rotated to a second position.

2. The punch as recited in claim 1 including an adjustment screw member passing through and threadedly secured to said horizontally directed adjusting seat member for contacting said top surface of said lower guide block for displacement of said lower guide block responsive to said rotation of said eccentric cam.

* * * * *